United States Patent [19]

Garzon

[11] 4,414,449

[45] Nov. 8, 1983

[54] QUICK OPEN AND CLOSE DISCONNECT SWITCH

[75] Inventor: Ruben D. Garzon, Malvern, Pa.

[73] Assignee: Brown Boveri Electric Inc., Rolling Meadows, Ill.

[21] Appl. No.: 267,372

[22] Filed: May 26, 1981

[51] Int. Cl.[3] ..... H01H 9/38

[52] U.S. Cl. ..... 200/146 R; 200/154

[58] Field of Search ..... 200/146 R, 144 R, 153 SC, 200/154, 149 R, 148 F, 148 R, 68, 69, 70, 71, 72 R, 72 A, 73, 74, 75, 76, 77, 78

[56] References Cited

U.S. PATENT DOCUMENTS 2,150,089 3/1939 Whitehead ..... 200/146 R 3,564,174 2/1971 Clarke ..... 200/77

*Primary Examiner*—Elliot A. Goldberg

*Assistant Examiner*—Morris Ginsburg

*Attorney, Agent, or Firm*—Ostrolenk, Faber, Gerb & Soffen

[57] ABSTRACT

A quick open and close disconnect switch suitable for use in EHV and UHV systems is disclosed. In addition to a conventional main moving contact and a conventional mechanism for operating it, a preferably much smaller, lighter auxiliary moving contact is provided. The main moving contact is moved away from (or toward) the stationary contacts to open (or close) the switch. While this is happening, the auxiliary moving contact is retained by means of a latch arrangement in its position engaged with (or remote from) the stationary contact. When the main moving contact has traversed a predetermined portion of its path, the auxiliary moving contact is released and is moved suddenly, with great speed, to its open (or close) position. The motive power for the auxiliary moving contact is preferably provided by a power spring which is compressed by the movement of the main contact.

19 Claims, 2 Drawing Figures

QUICK OPEN AND CLOSE DISCONNECT SWITCH

BACKGROUND OF THE INVENTION

The present application pertains generally to disconnect switches, and more particularly to disconnect switches suitable for use in extra high voltage (EHV) and ultra high voltage (UHV) systems.

Disconnect switches are used to isolate a component of an electrical system from the power source, for example for the purpose of maintenance. Because such switches are normally operated in routine situations, rather than in emergencies, they do not require the extremely high ratings and great speed of operation required of a full interrupter. Nonetheless, because the continuous current requirements for these switches are generally high, the main contacts must be large. In this connection, it should be noted that just as 500 kV and 700 kV systems have been developed as an overlay for the more conventional 300–385 kV systems, so systems designed to operate at 1000—1000 kV are in development as a future overlay for 500–700 kV systems. In the new systems being developed, a disconnect switch may typically require a switch surge withstand capability of 2300 kV, an impulse withstand capability of 1120 kV, a power frequency withstand capability of 2000 kV and the ability to carry 760 kV relative to ground without visible corona (these figures are for a 1000 kV system).

It is difficult, and requires a great deal of energy, to move a contact of this size quickly, and it is typical for the moving contact of a disconnect switch to move at the relatively slow speed of 1 foot per second or less in being opened or closed. During the opening of a disconnect switch, as is well known, there is a risk of generating overvoltages if the switch restrikes across its contacts. The likelihood of such a restrike occurring is related to the rate at which the dielectric capability of the gap between the opening contacts increases. The slowness of the stroke of a disconnect switch means that this capability is increased very slowly, greatly increasing the likelihood of restrikes. Moreover, as the recovery voltage increases, reignitions and restrikes are increasingly likely to occur.

In the closing operation as well, overvoltages may be produced by prestrikes across the contacts. If the switch prestrikes, a line charging current flow is initiated, but as the current crosses its zero before the contacts of the switch have closed completely, the switch attempts to interrupt the current. Because the gap between the contacts is decreasing, although slowly, a voltage breakdown across the gap occurs. Again, because of the low speed of the moving contact and the correspondingly great time required for the closing stroke, the likelihood of overvoltages is increased.

SUMMARY OF THE INVENTION

It is the principal object of the present invention to provide a disconnect switch that can be opened or closed quickly compared to the prior art.

It is another object of the invention to provide such a switch having a moving contact that can be moved at speeds as high as 20–30 feet per second during opening and closing.

It is still another object of the invention to provide such a switch in which the foregoing objects can be attained without greatly increasing the amount of energy required to open or close the switch, as compared to the prior art.

It is still another object of the invention to provide a disconnect switch in which the danger of pre-striking during closing or restriking during the opening is greatly reduced, thereby reducing or eliminating the risk of potentially dangerous overvoltages.

It is yet another object of the invention to provide a novel design for a disconnect switch to which existing switches can be easily adapted to retrofitting.

It is yet a further object of the invention to provide a switch having a movable contact that can be latched in either the open or the closed position.

According to the present invention, the foregoing objects are attained by means of a disconnect switch having two sets of contacts. A principal moving contact and its operating mechanism and a stationary contact are of conventional design. An auxiliary moving contact is provided concentric with and surrounded by the main moving contact, and an auxiliary stationary contact concentric with and surrounded by the main stationary contact may be provided. Alternatively, a single stationary contact may be provided, its radially outer portion being adapted to engage the main moving contact and its radially central portion being adapted to engage the auxiliary moving contact. The auxiliary moving contact is preferably powered, for both an opening and a closing stroke, by means of a compression spring. For an opening stroke, the main moving contact is opened in the normal manner, while the auxiliary moving contact remains engaged with the stationary contact. The movement of the main moving contact compresses the power spring, during which process the auxiliary moving contact is retained in engagement with the stationary contact by means of a latch arrangement. When the opening stroke of the main moving contact has been nearly completed, it actuates a trip mechanism which releases the latch arrangement holding the auxiliary moving contact in place, allowing the power spring to drive the auxiliary moving contact very quickly out of engagement with the stationary contact. Since the auxiliary moving contact is quite small compared to the main moving contact, very high speeds can be attained in this manner without the use of an undue amount of energy.

Similarly, for a closing stroke, the main moving contact is moved in the normal manner slowly toward the stationary contact, while the auxiliary moving contact is held at a fixed distance from the stationary contact by means of a latch arrangement. The movement of the main moving contact again compresses the power spring, and actuates a trip mechanism to allow the power spring to drive the auxiliary moving contact immediately into engagement with the stationary contact. Thus, during a closing stroke, the auxiliary contact is thrust quickly into engagement with the stationary contact before the main moving contact engages the stationary contact. There is, therefore, relatively little danger of a prestrike between the main moving contact and the stationary contact, and the danger of a prestrike between the auxiliary moving contact and the corresponding stationary contact is minimal due to the great speed of the auxiliary moving contact. Similarly, during the opening stroke, the circuit is not actually broken until the main moving contact is well away from the stationary contact, eliminating the danger of restrikes between it and the stationary contact, while the great speed with which the auxiliary moving contact is retracted from the stationary contact keeps the danger of a restrike between them to a minimum.

Other objects and features of the invention will be apparent from the following description and the accompanying drawings.

DETAILED DESCRIPTION OF THE PREFERRED EMBODIMENT

Figure 1:
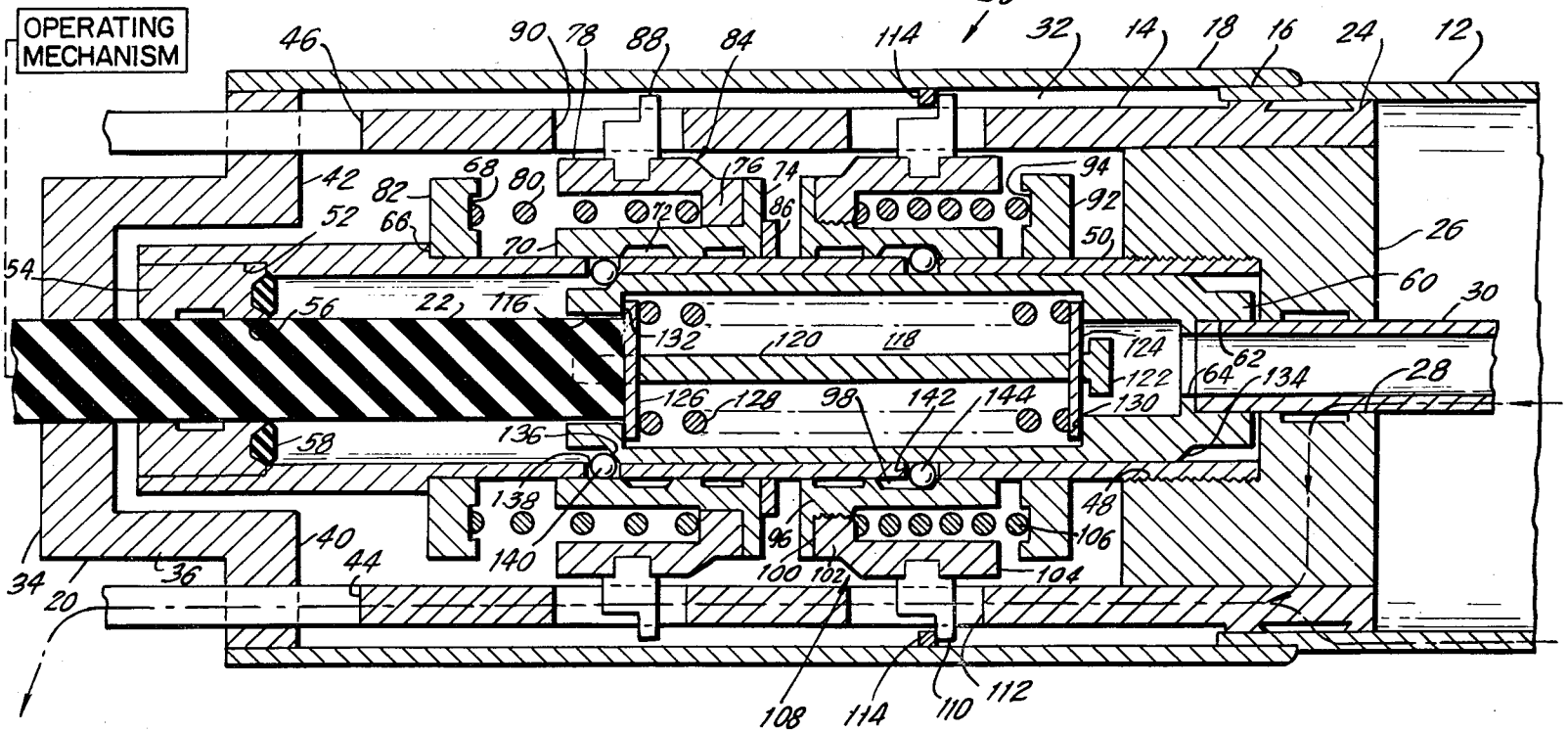
FIG. 1 is a detail of an EHV or UHV disconnect switch employing the present invention, showing the mechanism in the position it assumes when the contacts are closed.
Figure 2:
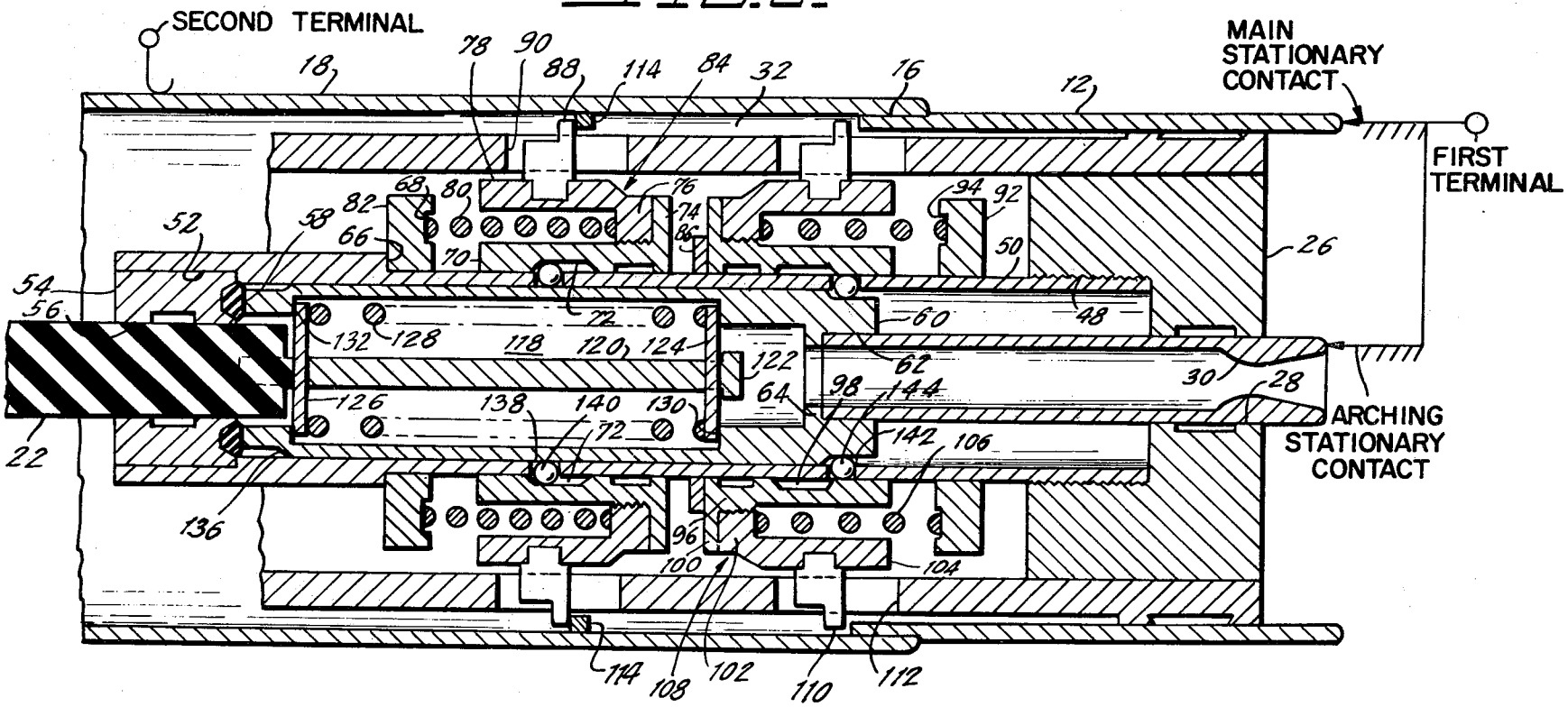
FIG. 2 is a view like that of FIG. 1, showing the mechanism with the contacts open.

FIGS. 1 and 2 show the novel device of the present invention in detail. In this view, it can be seen that the main contact 12 is cylindrical in form and is received about the outer circumference of the support tube 14. More specifically, the main contact 12 comprises a cylindrical tube, the forward (right-hand) end of which actually makes electrical contact with the stationary contact. (The forward end of the main contact 12 and the stationary contact are not shown in FIG. 1.) The rear or back end of the main contact 12 has a shoulder 16 formed on its outer circumference, on which is received the forward end of a cylindrical tube 18 which, like main contact 12, is made of a conductive material, and by means of which main contact 12 is connected to adapting plate 20 and insulated operating rod 22. The outer circumference of support tube 14 is provided at its forward end with a sliding transfer contact 24, and an end plug 26 containing a set of sliding transfer contacts 28 where auxiliary contact 30 makes sliding contact. An annular space 32 is defined between the outer surface of support tube 14 and the inner surface of tube 18. The back end of tube 14 is electrically connected to an end cap and to the bus. The adapting plate 20, which is made of a conductive material, has a radially inner portion which is fixed solidly to the insulating actuating rod 22. Inner portion 34 of the adapting plate 20 is preferably in the form of a disc, but it could have other shapes, for example that of a plurality of radial spokes. The radially outer portion of part 34 of the adapting plate 20 has connected to it an axial portion 36, whch is preferably cylindrical, although it again could be in the form of axial spokes. Portion 36 extends axially toward the front end of the moving contact assembly 38, that is toward the stationary contact structure. The forward end of portion 36 is connected to the radially inner end of each of a plurality of radially-extending spokes 40, 42 which extend through apertures 44, 46 respectively, in support tube 14 and are secured at their radially outer end to the back portion of tube 18. Only two spokes 40, 42 are shown, but it will be understood that any larger number can be used. The adapting plate 20, which includes portions 34 and 36 as well as spokes 40 and 42, is preferably a single integral element of a conductive material, and is preferably welded to rod 22 and tube 18. In this manner, main contact 12 is supported. The current paths are indicated by the arrows in FIG. 1.

The forward end of support tube 14 receives within its inner diameter a cylindrical block 26 which has formed within it a coaxial groove containing a transfer contact 28 in its front surface, and a bore 48 of larger diameter in its back surface. A conductive cylindrical tube 50 is received in bore 48 and is permanently secured therein to block 26. The back end of tube 50 has an annular shoulder 52 formed in its inner surface, in which an annular conductive block 54 is permanently secured. The actuating rod 22 is slidably received in the bore 56 of block 54. There is a spacing between the inner surface of tube 50 and the surface of rod 22. An annular bumper 58, preferably of urethane or the like, is provided on the forward surface of block 54 facing this annular space for a purpose to be described below. The forward end of rod 22 is received in the interior of a latch piston 60, which is a generally cylindrical hollow body. The forward end of latch piston 60 has a bore 62 having an annular flange 64 on its surface. The auxiliary moving contact 30 is received in and is secured to bore 62 and annular flange 64.

Latching mechanisms, which will now be described, are provided on the exterior surface of tube 50. The outer surface of tube 50 is provided with a shoulder 66 spaced axially some distance forward of the bumper 58. An annular shelf 82 is received on shoulder 66 and has an annular groove or recess 68 on its forward surface. Farther forward, an inner sleeve 70 is located in sliding engagement with the outer surface of tube 50. The inner surface of sleeve 70 is provided with at least one groove 72, whose purpose is described hereinbelow. The forward end of sleeve 70 is provided with a radially-outward extending flange 74, and an outer sleeve is secured thereto as by welding. The outer sleeve includes a forward part or collar 76, which is secured to the back side of flange 74 and the adjacent portion of the outer surface of inner sleeve 70. From the back outer portion of collar 76 extends a cylindrical element 78, which extends axially rearward, parallel to and spaced radially outward from inner sleeve 70. A helical reset spring 80 is received in the cylindrical space thus defined between inner sleeve 70 and portion 78 of the outer sleeve, the back end of the spring 80 being received in groove or recess 68 on shelf 82, and the forward end of the spring 80 resting against the back surface of collar 76. This spring urges the rear latching device 84 forward. A stop 86, which may be for example annular, is secured as by welding to the outer surface of tube 50 to define the forward limit of motion therealong of the rear latching device 84. The radially outer surface of element 78 is provided with a plurality of radially-outward-extending tabs 88, each of which extends through a corresponding aperture 90 in support tube 14. Each tab 88 extends into space 32 between the support tube 14 and tube 18, for a purpose to be described below.

The forward latch similarly includes an annular shelf 92 secured to tube 50 and having an annular groove or recess 94 formed on its back surface. An inner sleeve 96 is provided in sliding contact with the outer surface of tube 50, rearward of shelf 92. At least one groove 98 is provided on the inner surface of inner sleeve 96 for a purpose to be described later. Inner sleeve 96 has a radially-outward-extending flange 100 at its back end. An annular collar 102 is secured as by welding to the forward surface of flange 100 and to the adjacent portion of the outer surface of sleeve 96. A cylindrical element 104 is secured to the forward, radially outer portion of collar 102, and is preferably continuous and integral therewith. Cylindrical element 104 extends axially forward, parallel to and spaced from the outer surface of sleeve 96. A helical spring 106 has its forward end received in groove or recess 94 and its back end in contact with collar 102, urging the forward latch 108 rearward. The rearward motion of the forward latch 108 is limited by stop 86. The outer surface of element 104 is provided with a plurality of tabs 110, each of which extends through a corresponding aperture 112 provided in the support tube 14, and projects into the space 32 defined between the support tube 14 and tube 18. A trip ring 114 is provided secured to the inner surface of tube 18 at a location that is axially between the portion of tabs 110 that project into space 32, and the portions of tabs 88 that project thereinto. Trip ring 114 serves to actuate the latch mechanism 84 and 108 in a manner to be described below.

The detailed structure of the latch piston 60 and co-operating elements will now be described. As noted above, the forward end of latch piston 60 is provided with a first bore 62 in which the auxiliary movable contact 30 is fixedly received, and has a second bore 116 at its back end in which actuating rod 22 is slidably received. The diameter of bore 116 is preferably greater than that of bore 62. Whether or not this is the case, the main portion of the interior of latch piston 60 is a cavity 118 having a third diameter which is larger than that of either of bores 62 and 116. The actuating rod 22 has a second section 120 of smaller diameter than the main portion of the rod 22. When the disconnect switch is in the closed position, as shown in FIG. 2, the forward end of the thicker portion of the actuating rod 22 is flush with the back end surface 132 of cavity 118. The thin-diameter portion 120 of the actuating rod 22 is at least equal in length to the cavity 118, and terminates in a radial flange 122, which extends into the rear portion of bore 62 when the switch is stationary in either its open or its closed position. Two annular plates 124, 126 are mounted on the thin portion 120 of the actuating rod for sliding movement therealong. Both of these flanges 124, 126 have a diameter larger than that of either of bores 62 and 116, and are received in the cavity 118. A helical coil spring 128 is provided between and abutting both of discs 124, 126, and urging them against the forward and back end surfaces 130, 132 of the cavity 118, respectively.

The intermediate portion of latch piston 60 has an outer diameter substantially equal to the inner diameter of tube 50, in which it is received slidingly. The forward portion of the outer surface of latch piston 60 has a relatively small diameter portion, so that it is spaced from the interior surface of tube 50, in which the latch piston 60 is received. The back portion of the latch piston 60 similarly has a relatively small-diameter outer surface. Each of these small diameter portions is bounded by a respective beveled latching edge 134, 136, the purpose of which is described below. The wall of tube 50 is provided with a first plurality of apertures 138 lying in a plane perpendicular to the axis of the switch and each containing a respective ball 140. The apertures 138 are located so that when the rear latch 84 is in its farthest forward position, i.e. urged against stop 86 by reset spring 80, the groove 72 provided on the interior surface of the inner sleeve 70 is slightly forward of apertures 138. The diameter of balls 140 is greater than the thickness of tube 50, but is smaller than the sum of the thickness of tube 50 and the radial depth of latching edge 136, and is also less than the sum of the thickness of tube 50 and the depth of groove 72. When the switch is in its closed position, as in FIG. 1, the balls 140 protrude into the space between tube 50 and the outer surface of the back portion of latch piston 60 defined by latching edge 136, latching the latch piston 60 in the position shown.

Similarly, a second plurality of apertures 142 is provided in tube 50, in a plane perpendicular to the axis of the switch, each aperture 142 accommodating a corresponding ball 144. Apertures 142 are so located that when the forward latch 108 is in its rearmost position, i.e. urged against stop 86 as in FIG. 2, groove 98 provided in the interior surface of inner sleeve 96 is just rearward of apertures 142. The diameter of the forward balls 144 is greater than the thickness of the tube 50, but is less than either the sum of the thickness of the tube 50 and the radial depth of latching edge 134, or the sum of the thickness of tube 50 and the depth of groove 98. The axial length of the relatively large-diameter middle portion of latch piston 60 is such that when the switch is in its closed position, as shown in FIG. 1, the rear balls 140 protrude into the space between tube 50 and the rear portion of latch piston 60 defined by latching edge 136, while the forward balls 144 lie against the relatively thick middle portion of latch piston 60 and protrude into groove 98 of the forward latch 108; when the switch is in the open position, as shown in FIG. 2, the forward balls 144 protrude into the space between tube 50 and the forward portion of latch piston 60, while the rear balls 140 engage the surface of the thick middle portion of the latch piston 60 and protrude into groove 72 of the rear latch 84.

The operation of the novel disconnect switch of the present invention can now be explained.

It will be assumed that the switch is initially in the closed position, as shown in FIG. 1, and is to be opened in order to isolate part of an electric circuit for inspection, maintenance, repair or the like. The switch is actuated by the movement rearward of main contact 12 by means of actuating rod 22, which is actuated and powered by any suitable conventional means. An operating mechanism is schematically illustrated in FIG. 1. In FIG. 2 there is schematically illustrated a main stationary contact and an arcing stationary contact which cooperate with respective movable contacts 12 and 30 and first and second terminals for the disconnect switch structure. The leftward motion of the actuating rod 22 is transmitted via adapting plate 20 to tube 18 and main contact 12, which is thus withdrawn from contact with the stationary contact structure (not shown). The rear balls 140, however protrude behind the latch piston 60 and prevent it from moving rearward. As a result, the auxiliary moving contact 30 remains engaged with the stationary contact, so that the circuit is not yet broken. The leftward movement of flange 122 forces plate 124 to the left, compressing power spring 128. Main contact 12 is moved sufficiently far to the rear that trip ring 114 engages tabs 88, moving the rear latch 84 rearward. This motion of the rear latch 84 brings groove 72 into axial alignment with the rear balls 140, which are driven by the force of spring 128 outward into groove 72. This allows the latch piston 60 to move to the left, which it does with great speed, driven by the compression of power spring 128. In this manner, the auxiliary moving contact 30 is quickly withdrawn from engagement with the stationary contact, breaking the circuit. At the time the circuit is finally broken, however, the main contact 12 is already a long distance from the stationary contact, and the great speed of the auxiliary moving contact 30 keeps the danger of restrikes and the consequent overvoltages to a minimum. The leftward movement of the auxiliary moving contact 30 and latch piston 60 is stopped by urethane bumper 58. The final position is that shown in FIG. 2.

When the latch piston 60 has moved all the way to the left and assumed the position shown in FIG. 2, its thick middle portion clears the forward apertures 142, allowing the forward balls 144 to be forced by reset spring 106 radially inward in front of latch piston 60, while the reset spring 106 drives the forward latch 108 rearward against stop 86, taking the groove 98 out of alignment with apertures 142 and thus locking the switch in the open position.

When it is desired to close the switch, after the inspection, maintenance, etc. has been completed, the reverse procedure is used. The actuating rod 22 is moved forward, i.e. to the right, in conventional manner, and its motion is transmitted by adapting plate 20 to tube 18 and the main moving contact 12. The latch piston 60 is held in position, however, by the protrusion of the forward balls 144 in front of it, as shown in FIG. 2. The forward movement of actuating rod 22 forces disc 126 forward, compressing power spring 128. When the moving contact 12 has advanced sufficiently to bring the trip ring 114 into engagement with tabs 110, the trip ring 114 moves the forward latch 108 forward sufficiently to bring groove 98 into axial alignment with apertures 142. The force of spring 128 drives the forward balls 144 into groove 98, allowing latch piston 60 to be driven by spring 128 violently forward to the position shown in FIG. 1, in which the auxiliary moving contact 30 is in engagement with the stationary contact. In this way, the final closing of the gap between the moving contacts and the stationary contact is effected by the sudden closing stroke of the auxiliary moving contact 30 powered by spring 128, rather than the slow movement of main contact 12, reducing the length of time that there is only a small gap between the moving contacts and the stationary contact and thus reducing the likelihood of prestrikes. Again, when the latch piston 60 has attained its forwardmost position, as shown in FIG. 1, the rear balls 140 are driven by reset spring 80 back into the space behind the latch piston 60, and the rear latch 84 is driven forward against stop 86, locking the latch piston 60 in the forward (switch closed) position.

The present invention may be embodied in other specific forms without departing from the spirit or essential attributes thereof, and, accordingly, reference should be made to the appended claims, rather than to the foregoing specification, as indicating the scope of the invention.

What is claimed is:

1. A disconnect switch, comprising:

stationary contact means;

first terminal means electrically connected to said stationary contact means;

a first moving contact;

a second moving contact;

second terminal means electrically connected to said first and second moving contacts;

means for moving said first moving contact at a first speed between a first position in which it is in electrical and mechanical contact with said stationary contact means and a second position in which it is spaced from and out of electrical contact with said stationary contact means, and for moving said second moving contact at a second speed greater than said first speed between a third position in which it is in electrical and mechanical contact with said stationary contact means and a fourth position in which it is spaced from and out of electrical contact with said stationary contact means;

latching means for retaining said second moving contact in said third position while said first moving contact moves from said first position towards said second position, until said first moving contact has moved a first predetermined distance towards said second position for retaining said second moving contact in said fourth position when said first moving contact moves from said second to said first position, until said first moving contact has moved a second predetermined distance toward said first position, and latch defeating means for defeating said latching means to release said second moving contact once said first moving contact has moved said first predetermined distance; said latch defeating means further defeating said latching means to release said second moving contact once said first moving contact has moved said second predetermined distance.

2. The switch of claim 1, wherein said latching means comprises a first latch for retaining said second moving contact in said third position and a second latch for retaining said second moving contact in said fourth position.

3. The switch of claim 2, wherein said first and second latches each have a respective latching condition in which they retain said second moving contact in said fourth and said third positions, respectively, and respective reset conditions, said first latch being in its said reset condition when said second latch is in its said latching condition, and said second latch being in its said reset condition when said first latch is in its said latching condition.

4. The switch of claim 3, wherein said latching means further comprises first and second springs respectively urging said first and second latches into their said latching conditions.

5. The switch of claim 1, wherein said moving means comprises a rod for moving said first moving contact between said first and second positions.

6. The switch of claim 5, wherein said moving means further comprises power spring means adapted to be compressed by movement of said rod, said power spring means being adapted to drive said second moving contact at said second speed when said latch defeating means causes said latching means to release said second moving contact.

7. The switch of claim 6, wherein said latching means further comprises latch piston means having a cavity therein and containing said power spring means in said cavity; said first moving contact, said second moving contact and said latch piston means being coaxial, and said latch piston means having a first end secured to said second moving contact, said power spring means acting on said latch piston means to drive said second moving contact when the latter is released by said latching means.

8. The switch of claim 7, wherein said rod is received slidably in said latch piston means and extends into said cavity thereof, said rod being adapted to compress said power spring means along a direction parallel to the axis of said latch piston means.

9. The switch of claim 7, wherein said latching means comprises a first latch for retaining said second moving contact in said third position and a second latch for retaining said second moving contact in said fourth position.

10. The switch of claim 9, wherein said first and second latches each have a respective latching condition in which they retain said second moving contact in said fourth and said third positions, respectively, and respective reset conditions, said first latch being in its said reset condition when said second latch is in its said latching condition, and said second latch being in its said reset condition when said first latch is in its said latching condition.

11. The switch of claim 10, wherein said latch piston means has a first latching edge for being engaged by said first latch when said first latch is in its said latching condition, and said latch piston means having a second latching edge for being engaged by said second latch when said second latch is in its said latching condition.

12. The switch of claim 11, further comprising a cylindrical tube having a wall of predetermined thickness, and wherein said latch piston means is generally cylindrical and is received in said cylindrical tube, and wherein said first and second latches comprise first and second sleeve means, respectively, in sliding engagement with the outer surface of said tube; each said sleeve means having a cylindrical inner surface engaging said tube slidingly and being formed with a groove therein; and said tube having a first aperture formed therein and said first latch including a first ball received in said aperture, the diameter of said ball being greater than said thickness of said wall of said tube; and said tube having a second aperture formed therein and said second latch comprising a second ball having a diameter greater than said thickness of said wall of said tube.

13. The switch of claim 12, wherein said first ball is received partially in said first aperture and protrudes therefrom into the interior of said tube to engage said first latching edge when said first latch is in its said latching condition, and said first ball being received partially in said first aperture and protruding into said groove of said first latch when said first latch is in its said reset condition; and said second ball being received partially in said aperture and protruding into the interior of said tube to engage said second latching edge when said second latch is in its said latching condition, and said second ball being received partially in said second aperture and protruding into said groove of said second latch when said second latch is in its said reset condition.

14. The switch of claim 7 or claim 12, further comprising bumper means for absorbing at least a portion of the energy of said latch piston means and of said second moving contact at the end of an opening stroke of said switch.

15. The switch of claim 14, wherein said bumper means comprises an annular bumper of urethane.

16. A latch mechanism for a disconnect switch having cooperable main moving and main stationary contacts and an operating device for operating the main movable contact, said latch mechanism comprising:

a moving contact adapted to be placed in a conventional disconnect switch, inside and concentric the main moving contact of the switch;

said moving contact being adapted for installation so as to be movable between a first position, in which it will engage the stationary contact of the switch, and a second position, in which it will not engage the stationary contact;

moving means for moving said moving contact from said first to second position responsive to movement of the switch's moving contact out of engagement with the stationary contact thereof, said moving means being adapted to move said moving contact substantially faster than the switch's moving contact can move;

latching means adapted to be installed inside the main moving contact of the switch; said latching means being for retaining said moving contact in said first position while the switch's main moving contact moves out of engagement with the stationary contact thereof; and latch defeating means adapted to be installed in a disconnect switch and adapted to cooperate with the main moving contact thereof to defeat said latching means, to release said moving contact for movement by said moving means, once the main moving contact of the switch has moved a predetermined distance from the stationary contact thereof.

17. The mechanism of claim 16, wherein said moving means comprises power spring means adapted to cooperate with the operating device of a conventional disconnect switch in such a manner as to be compressed during motion of the main moving contact of the disconnect switch, said power spring means being released to move said moving contact when said latch defeating means defeats said latching means.

18. The mechanism of claim 17, wherein said moving means further comprises a cylindrical tube having a wall of predetermined thickness and generally cylindrical latch piston means slidably received in said tube and having a cavity containing said power spring means; said generally cylindrical latch piston means being secured rigidly to said moving contact; said latching means comprising a sleeve having an inner surface in sliding engagement with said tube; said tube having an aperture formed therein and said latching means further comprising a ball received in said aperture and having a diameter greater than said thickness of said wall of said tube; said ball being adapted to engage said latch piston means to maintain it stationary.

19. The mechansim of claim 18, wherein said inner surface of said sleeve has a groove formed therein, and wherein said latch defeating means is adapted to move said sleeve to bring said groove into alignment with said aperture to receive said ball therein, and the force of said power spring means serving to push said ball into said aperture.

* * * * *